US010036529B2

(12) United States Patent
Swanson

(10) Patent No.: US 10,036,529 B2
(45) Date of Patent: Jul. 31, 2018

(54) LAMP SHADE

(71) Applicant: LAMPS PLUS, INC., Chatsworth, CA (US)

(72) Inventor: Dennis K. Swanson, Woodland Hills, CA (US)

(73) Assignee: LAMPS PLUS, INC., Chatsworth, CA (US)

( * ) Notice: Subject to any disclaimer, the term of this patent is extended or adjusted under 35 U.S.C. 154(b) by 219 days.

(21) Appl. No.: 15/212,836

(22) Filed: Jul. 18, 2016

(65) Prior Publication Data

US 2018/0017229 A1 Jan. 18, 2018

(51) Int. Cl.
*F21V 1/04* (2006.01)
*F21V 3/00* (2015.01)

(52) U.S. Cl.
CPC . *F21V 1/04* (2013.01); *F21V 3/00* (2013.01)

(58) Field of Classification Search
CPC ..... F21V 1/04; F21V 3/00
USPC ..... 362/358
See application file for complete search history.

(56) References Cited

U.S. PATENT DOCUMENTS 4,625,268 A * 11/1986 Payne ..... F21V 1/00 362/352
6,302,566 B1 * 10/2001 Cohon ..... F21V 1/04 362/351
2003/0016523 A1 * 1/2003 Pickens ..... F21V 1/10 362/35

* cited by examiner

*Primary Examiner* — Stephen F Husar
(74) *Attorney, Agent, or Firm* — Karish & Bjorgum, PC

(57) ABSTRACT

A lamp shade including a standard lampshade secured to a wire frame having a top ring and a bottom ring and a curtain secured to a curtain shade ring which is supported by being affixed to the terminus of sider wires extending beyond the top ring so that the top and bottom of the curtain extends above and below the top and bottom rings.

7 Claims, 4 Drawing Sheets

LAMP SHADE

FIELD OF THE INVENTION

The present invention relates generally to lighting apparatus and more specifically to lamps of various types having shades thereon.

BACKGROUND OF THE INVENTION

Lamps of various types generally have a lamp shade which surrounds the illumination device. The lamp shade performs the function generally of directing the light from the illumination device in a downward or upward direction, and in some instances, both. The lamp shade also is utilized to prevent the light from the illumination device directly impacting individuals who are in the vicinity of the lamp. The lamp shade also can serve to defuse the light. Lamps of all types such as table lamps, desk lamps, floor lamps, wall mounted lamps, chandeliers and the like are designed in such a way as to include a lamp shade. In many instances and particularly with regard to table lamps, desk lamps and floor lamps, the lamp shade is supported on a lamp harp which is affixed to the base of the lamp and extends upwardly and it has a threaded extension which is adapted to extend through an opening in a washer-like member that is formed integrally with a spider that is usually secured to a top ring of a wire frame upon which the shade is mounted. A finial is secured to the threaded extension on the lamp harp to hold the shade in place on the lamp.

In many instances it is desirable to have the light emanating from the illumination device of the lamp diffused even greater than that which is accomplished by the utilization of the traditional lamp shade. There is, therefore, a need for a structure on the lamp shade to provide greater diffusion of the light emanating from the illumination devices.

SUMMARY OF THE INVENTION

A lamp shade having a curtain shade which includes a lamp shade wire frame including a top and a bottom ring, a lamp shade having a top and a bottom secured to the wire frame, a spider including four equiangularly spaced apart wires each having a terminus extending beyond the top ring, a curtain shade ring secured to the terminus of two of the spider wires which are spaced 180° apart, first and second short metal tubes secured respectively to the terminus of the remaining two spider wires, the curtain shade ring being detachably disposed within each of the first and second metal tubes and a curtain having a top and bottom secured to the curtain shade ring and extending downwardly beyond the bottom of the lamp shade.

DETAILED DESCRIPTION OF THE INVENTION

Figure 1:
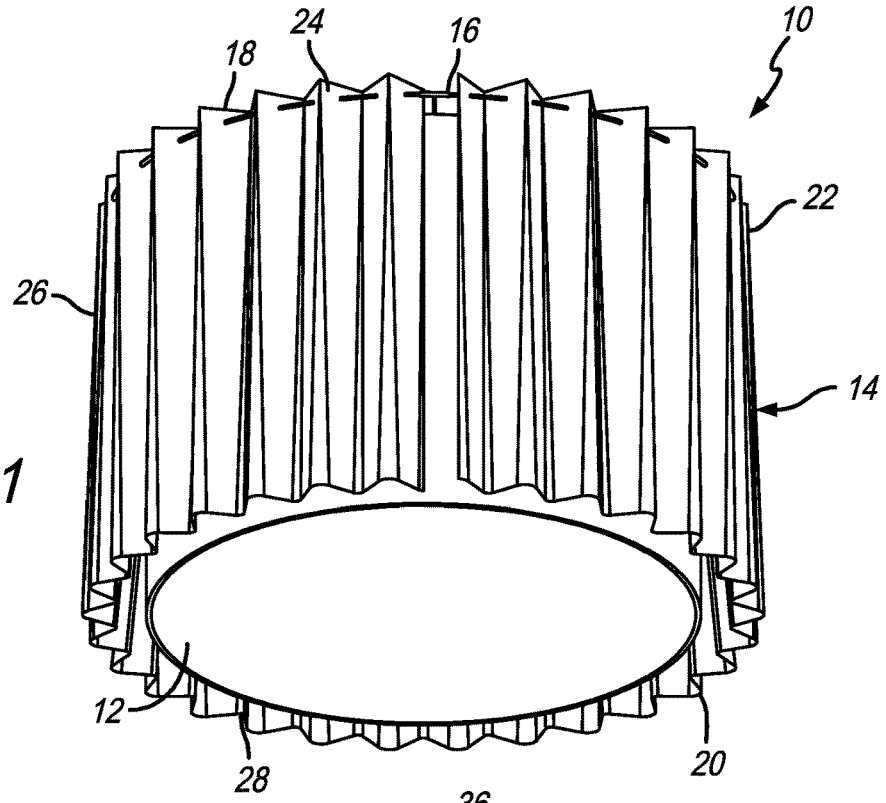
FIG. 1 is a bottom perspective view of a lamp shade constructed in accordance with the principles of the present invention.

Referring now more particularly to FIG. 1, there is illustrated in perspective view a lamp shade 10 constructed in accordance with the principles of the present invention. As is therein shown, the lamp shade 10 includes a typical lamp shade 12 of the type well known in the art and may include a wire frame having top and bottom rings with a blank of material secured thereto. The typical lamp shade 12 may be a drum type or bell type or other well-known types of lamp shades. To complete the construction of the lamp shade 10 constructed in accordance with the principles of the present invention, a curtain 14 is supported on a curtain shade ring 16 and the curtain has a top 18 and a bottom 20 and, as illustrated, the curtain 14 is supported in such a manner that the top and bottom thereof extends above and below the top and bottom of the standard lamp shade 12. As is shown in FIG. 1, the curtain 14 is divided into four separate discrete sections 22, 24, 26 and 28.

Figure 2:
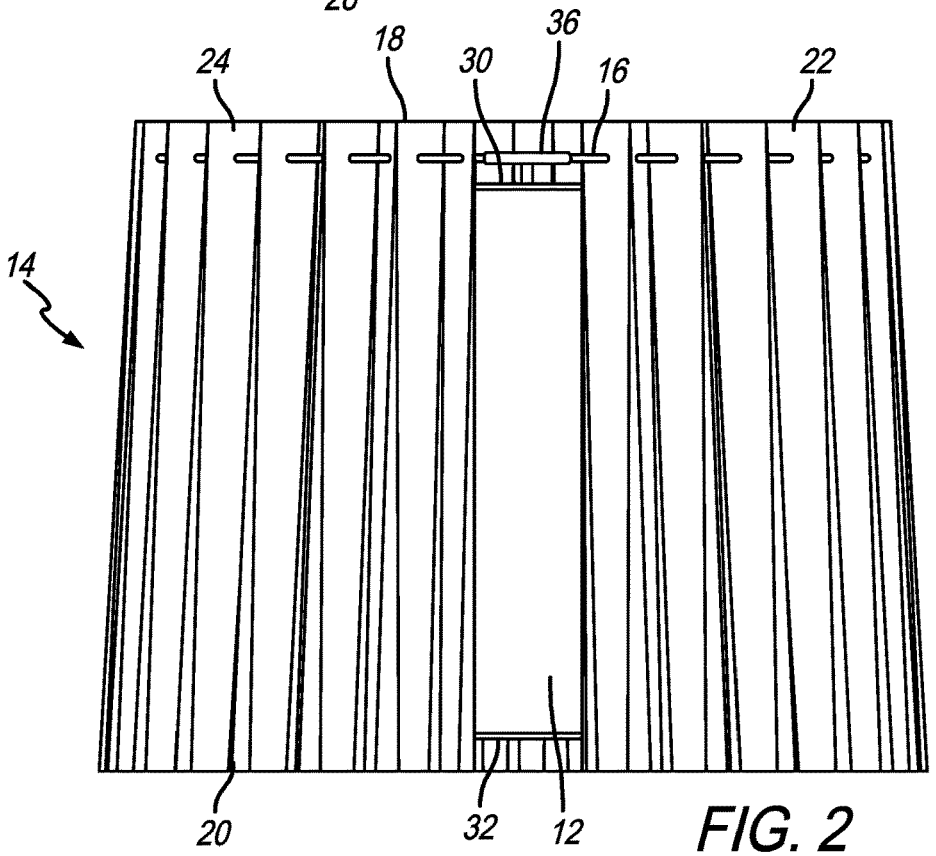
FIG. 2 is a plan view of the lamp shade of FIG. 1.

FIG. 2 to which reference is hereby made, also illustrates the lamp shade constructed in accordance with the present invention from a plan view which illustrates in greater detail the top ring 30 and the bottom ring 32 of the traditional lamp shade 12. It also illustrates a relationship between the top ring 30 of the lamp shade 12 and the position of the curtain shade ring 16 which extends above the top ring 30. It is also shown that the various discrete sections of the curtain shade 14 are held in place on the curtain shade ring 16 and through the elevation of the curtain shade ring 16 above the top ring 30, the top 18 of the curtain 14 extends above the top of the shade 12 and the curtain 14 is dimensioned so that the bottom 20 extends below the bottom ring 32 of the standard lamp shade 12.

Figure 3:
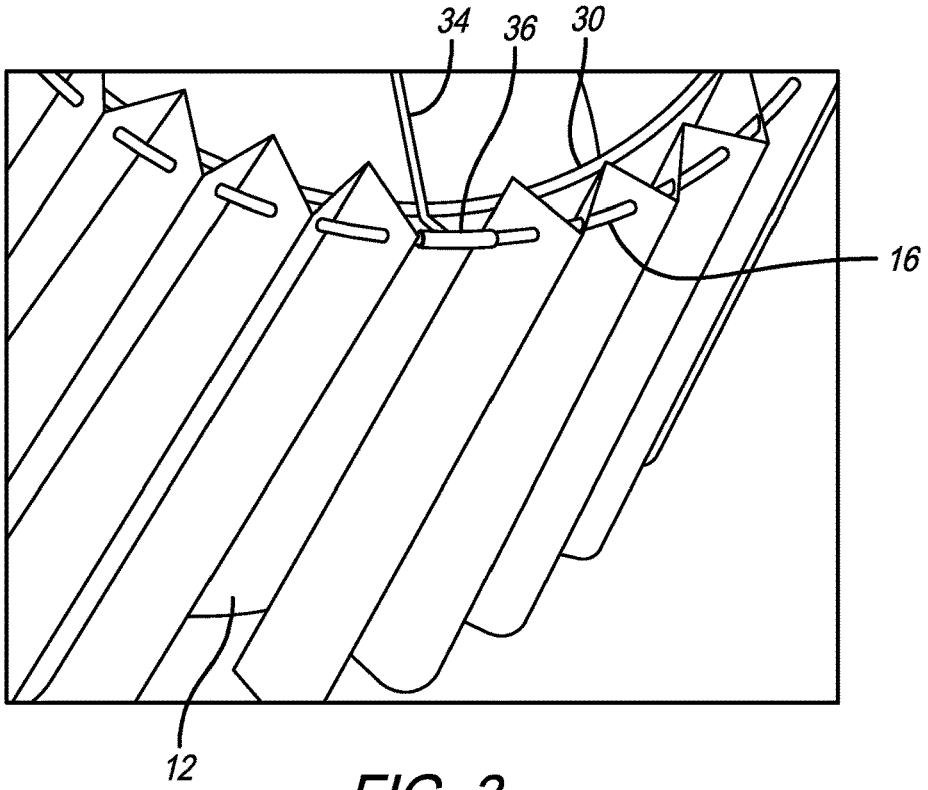
FIG. 3 is a perspective view of a portion of the lamp shade as illustrated in FIG. 1 showing some of the construction in greater detail.

Referring now more particularly to FIG. 3, there is illustrated in a top partial perspective view a portion of the lamp shade 10 illustrating in greater detail the manner in which the discrete sections of the curtain 14 are held in place on the curtain shade ring 16. As is shown in FIG. 3, a spider wire 34 (to be described in more detail below) extends beyond the top ring 30 of the standard lamp shade 12 and has a small tubular member 36 affixed thereto. As is shown, the shade ring 16 terminates in the small tubular member 36 and that relationship will be described in greater detail hereinbelow.

Figure 4:
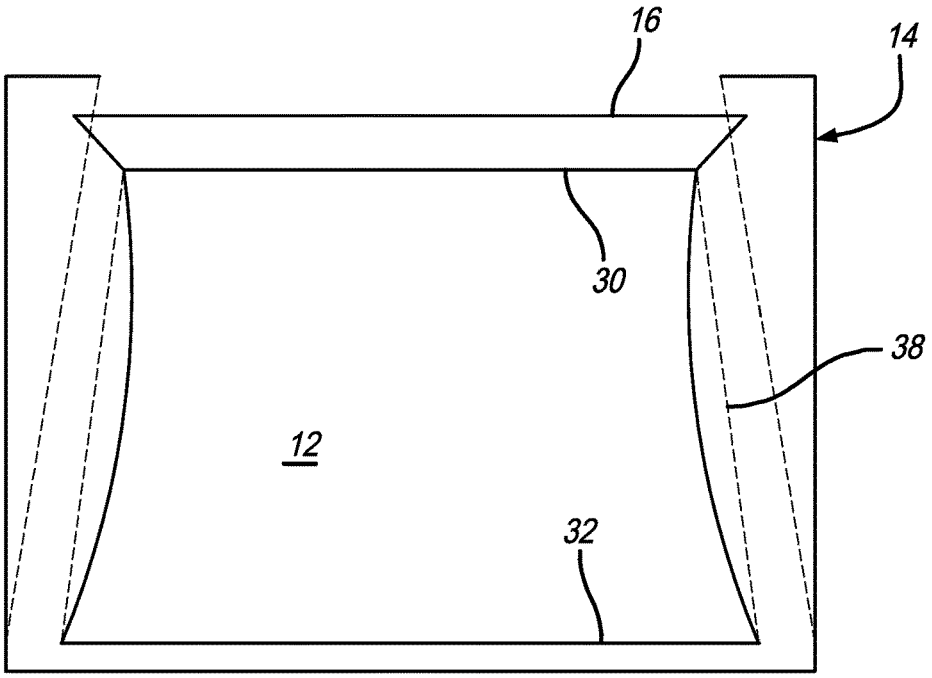
FIG. 4 is a schematic illustration showing various parts of a lamp shade constructed pursuant to the principles of the present invention.

Referring now more particular to FIG. 4, there is illustrated by a line drawing showing various features of the lamp shade constructed in accordance with the principles of the present invention. As is therein shown, the standard lamp shade 12 includes the top ring 30 and the bottom ring 32. The curtain shade ring 16 is supported above the top ring 30. The curtain 14 is supported on the curtain shade ring 16. As is shown, the standard lamp shade 12 may have a bell shaped configuration, or if desired, as is shown by the dashed line 38, may be a drum shape configuration.

Figure 5:
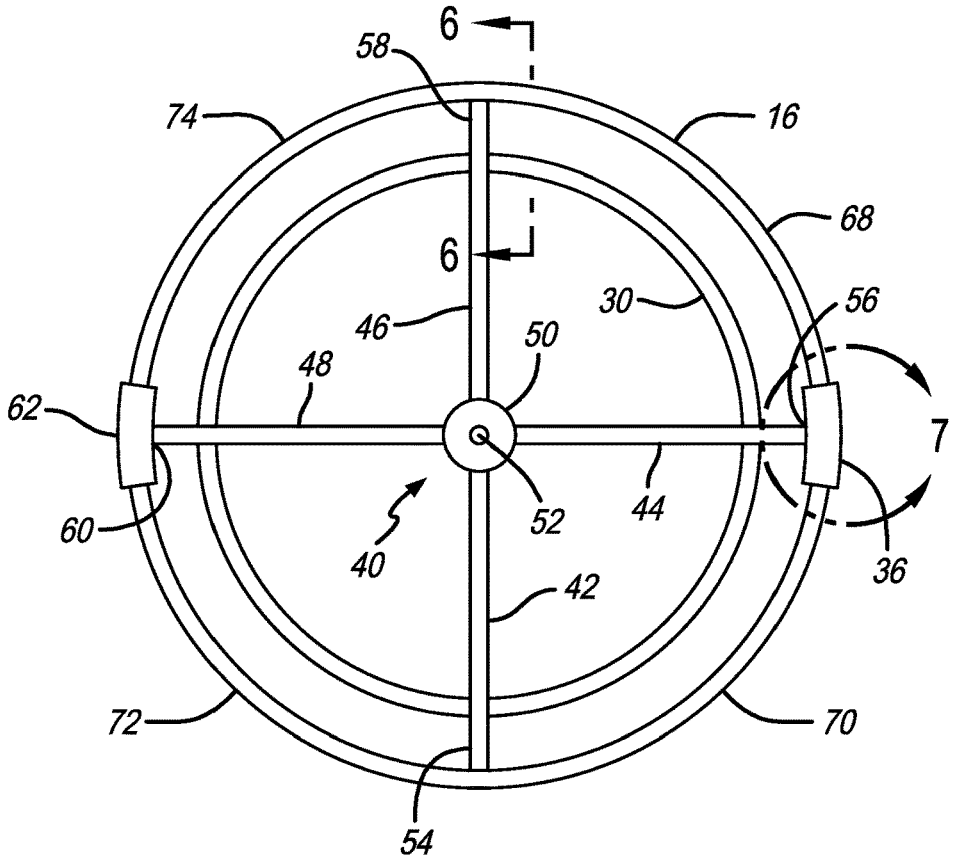
FIG. 5 is a top view illustrating portions of the lamp shade.
Figure 6:
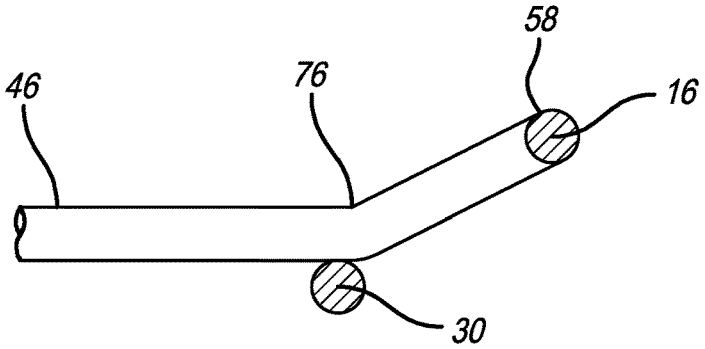
FIG. 6 is a partial cross-sectional view taken about the lines 6-6 of FIG. 5.
Figure 7:
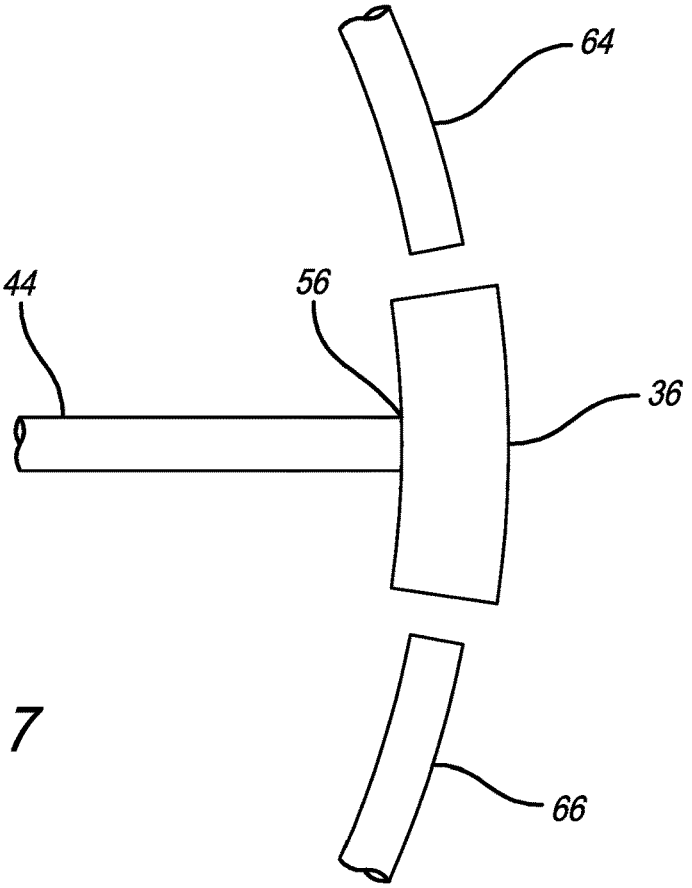
FIG. 7 is a partial exploded view of the area designated 7-7 in FIG. 5.

Referring now more particularly to FIG. 5, there is shown a top view illustrating the relationship between the top ring 30 and the curtain shade ring 16. As is therein illustrated, there is provided a spider 40 which is constructed of four spider wires 42, 44, 46 and 48. The spider wires extend radially outwardly from a washer-shaped member 50 defining an opening 52 therein which is adapted to receive the threaded extension that extends upwardly from the lamp harp as above referred to. Each of the spider wires has a terminus 54, 56, 58 and 60, respectively, extending beyond the top ring 30. The terminus 54 and 58 of the spider wires 42 and 46 are secured to the curtain shade ring 16 such as by welding. As noted, the spider wires 42 and 46 have terminus 54 and 58 which are 180° apart. The terminus 56 and 60 of the spider wires 44 and 48 are secured to the short tubular members 36 and 62 such as by welding. The curtain shade ring 16, as illustrated in FIG. 5, terminates at the short tubular members 36 and 62. As shown in FIG. 7, the curtain shade ring 16 is detachably disposed within the short tubular member 36 as illustrated by the ends 64 and 66 of the curtain shade ring 16 being detached from the short tubular member 36. A similar structure exists with regard to the short tubular member 62. As a result, when the curtain shade ring 16 ends are detached from the short tubular members 36 and 62, there will be provided four discrete sections 68, 70, 72 and 74 of the curtain shade ring 16. During normal operation, the curtain shade ring 16 is retained within the short metal tubes as a result of the resilience of the metal from which the curtain shade ring 16 is formed. If desired, the spider wires 42, 44, 46 and 48 may be secured to the top ring 30 at points displaced from the terminus thereof as shown in FIG. 5. Such is further illustrated by reference to FIG. 6 which shows spider wire 46 secured to the top ring 30 at a point displaced from the terminus 58 thereof, which is secured to the curtain shade ring 16. As is also shown, the spider wire 46 is bent at a point 76 adjacent the top ring 30 to cause the terminus 58 to be elevated above the top ring 30, thereby elevating the curtain shade ring 16 above the top ring 30 providing the ability for the curtain 14 to extend beyond the top of the standard lamp shade 12 as shown in FIGS. 1 and 12 and as above described. The spider wires 42, 44 and 48 are also bent in a similar fashion.

Figure 8:
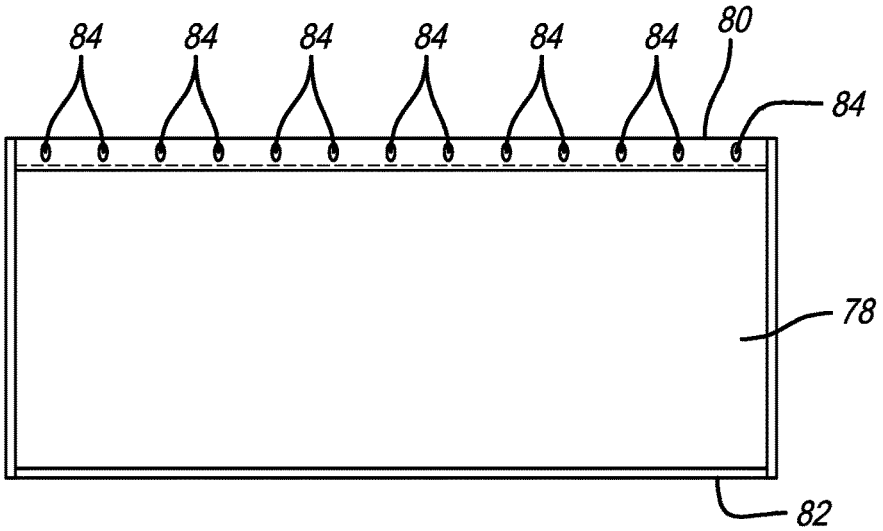
FIG. 8 is a schematic view illustrating one section of a curtain member used in accordance with the principles of the present invention.

As is shown in FIG. 8 to which reference is hereby made, one discrete section 78 of the curtain 14 is illustrated. As is therein shown, that discrete section has a top 80 and a bottom 82. Along the top 80 there are provided a plurality of openings 84 which may take the form, for example, of button holes. These openings or button holes are utilized to cooperate with the discrete sections of the curtain shade ring 16 so that each of the discrete sections of the curtain 14 can be secured on the curtain shade ring by threading each of the discrete sections of the curtain shade 14 as above described in conjunction with FIG. 1 on the discrete sections of the curtain shade ring, to thereby support individually each of the discrete sections of the curtain 14 on the discrete sections of the curtain shade ring 16. When the discrete sections of the curtain are threaded onto the discrete sections of the shade ring, the ends of the discrete sections of the shade ring such as shown at 64 and 66 are inserted into the short tubular members 32 and 62. Although the structure as above described refers to the spider wires being secured to the top ring by welding or the like, it should be understood that the structure including the spider wires and the curtain shade ring may be constructed as a stand-alone unit which can then be secured to any desired lamp by removing the lamp finial, positioning the structure on the threaded extension of the lamp harp and reattaching the lamp finial without departing from the scope of the present invention as defined by the claims.

There has thus been disclosed a lamp shade which is constructed of a combination of a standard lamp shade 12 which is surrounded by a curtain 14 to provide a greater diffusion of the light which is emanating from a light source which is covered by the lamp shade 10.

What is claimed is:

1. A lamp shade having a curtain shade comprising:
(A) a lamp shade wire frame including a top and a bottom ring;
(B) a lamp shade having a top and a bottom secured to said wire frame;
(C) a spider including four equiangularly spaced apart wires each having a terminus extending beyond said top ring;
(D) a curtain shade ring secured to the terminus of two of said spider wires which are spaced 180° apart;
(E) first and second short metal tubes secured respectively to the terminus of the remaining two spider wires;
(F) said curtain shade ring being detachably disposed within each of said first and second metal tubes; and
(G) a curtain having a top and a bottom secured on said curtain shade ring and extending downwardly beyond the bottom of said lamp shade.

2. A lamp shade as defined in claim 1 wherein each of said spider wires is secured to said top ring at a point displaced from the terminus thereof.

3. A lamp shade as defined in claim 1 wherein, when said curtain shade ring is detached from said short metal tubes, said curtain shade ring is divided into four ninety degree discrete sections.

4. A lamp shade as defined in claim 3 wherein said curtain includes four discrete sections, each curtain section being secured on a separate curtain shade ring discrete section.

5. A lamp shade as defined in claim 1 wherein said curtain defines a plurality of openings along one edge thereof and said curtain shade ring is threaded through said openings to secure said curtain to said shade ring.

6. A lamp shade as defined in claim 4 wherein each discrete section of said curtain defines a plurality of openings along one edge thereof and one said discrete section of said curtain shade ring is threaded through the openings in one discrete section of said curtain to secure said discrete section of said curtain to said discrete section of said curtain shade ring.

7. A lamp shade as defined in claim 1 wherein each said spider wire is bent upwardly at a point adjacent said top ring so that the top of said curtain extends beyond said top of said lamp shade.

* * * * *